United States Patent [19]

Kobayashi

[11] 4,446,656

[45] May 8, 1984

[54] LONG-TRAVEL ANNULAR VIBRATORY BARREL FINISHING APPARATUS FOR LINE-PROCESSING

[75] Inventor: Hisamine Kobayashi, Nagoya, Japan

[73] Assignee: Kabushiki Kaisha Shikishima Chipton, Nagoya, Japan

[21] Appl. No.: 335,665

[22] Filed: Dec. 30, 1981

Related U.S. Application Data

[62] Division of Ser. No. 137,441, Apr. 4, 1980, Pat. No. 4,317,313.

[51] Int. Cl.[3] ..... B24B 19/00

[52] U.S. Cl. ..... 51/7; 51/163.2

[58] Field of Search ..... 51/7, 163.1, 163.2

[56] References Cited

U.S. PATENT DOCUMENTS

| | | | |
|---|---|---|---|
| 2,749,669 | 6/1956 | Sleeper | 51/7 |
| 3,429,560 | 2/1969 | Huber | 51/163.2 |
| 3,981,693 | 9/1976 | Balz | 51/163.2 |
| 4,001,979 | 1/1977 | Elkins | 51/163.2 |
| 4,012,869 | 3/1977 | Balz | 51/163.2 |
| 4,067,147 | 1/1978 | Leligert | 51/163.2 |
| 4,195,447 | 4/1980 | Walther | 51/163.2 |

FOREIGN PATENT DOCUMENTS

| | | |
|---|---|---|
| DPB 1047993 | 7/1959 | Fed. Rep. of Germany . |
| DPB 1036092 | 8/1963 | Fed. Rep. of Germany . |
| 50-165558 | 4/1975 | Japan . |
| 53-141995 | 6/1978 | Japan . |

*Primary Examiner*—Harold D. Whitehead

*Attorney, Agent, or Firm*—Wenderoth, Lind & Ponack

[57] ABSTRACT

A long-travel annular vibratory barrel finishing apparatus for line-processing has an annular vibratory barrel constituted by at least one barrel line having opposing end barrel segments with a semicircular shape in plan and two straight barrel sections connected between opposing end barrel segments, such that the longer diameter (length) of said annular barrel is much greater than the shorter diameter (breadth) of the same. The annular vibratory barrel as a whole is mounted on a base through a plurality of springs for free vibration which is caused by a vibrator disposed at the center of the longitudinal axis of the annular vibratory barrel. As the vibrator is started, the annular vibratory barrel is vibrated to cause a spiral flow of mass therein. A workpiece transfer device is installed in association with the annular vibratory barrel or, alternatively, a workpiece charging device and a workpiece separating device are provided on the annular vibratory barrel, so that successive workpieces are line-processed automatically and continuously. The workpiece transfer device is arranged above the annular vibratory barrel in parallel with the latter, and is adapted to drive spindles carrying workpieces along the barrel while rotating the spindle. A workpiece chucking/unchucking section is provided at a portion of the path of the workpiece. The workpiece charging device and the workpiece separating device are disposed in parallel with each other at one end portion of the annular vibratory barrel.

9 Claims, 43 Drawing Figures

LONG-TRAVEL ANNULAR VIBRATORY BARREL FINISHING APPARATUS FOR LINE-PROCESSING

This application is a division of application Ser. No. 137,441, filed Apr. 4, 1980 now U.S. Pat. No. 4,317,313, and is related to divisional application Ser. Nos. 335,666 and 335,667, both filed Dec. 30, 1981.

BACKGROUND OF THE INVENTION

1. Field of the Invention

The present invention relates to a vibratory barrel finishing apparatus and, more particularly, to a long-travel annular vibratory barrel type finishing apparatus for line-processing.

Vibratory barrel finishing apparatuses are broadly divisible into two types: a box-type and a circular-type. The vibratory barrel finishing apparatus of the present invention possesses the advantages inherent in both these two types of apparatus, i.e. an oval path having adaptability for long line-finishing which is an advantage peculiar to the box-type apparatus and a spiral flow of mass which is an advantage of the circular-type apparatus.

2. Description of the Prior Art

German Patents DBP1047993, DBP1036092 and U.S. Pat. No. 3,071,900, disclose vibratory finishing apparatuses in which the line of the conventional box-type vibratory barrel is extended. In this known type of apparatus, however, a huge driving means is required for effecting the driving, separation and circulation of mass, resulting in an impractically high cost of production. A circular type apparatus having an extended line is disclosed in Japanese Patent Publication No. 16558/1975, as well as in Japanese Patent Laid-open Publication No. 141995/1978. The length of the extended line, however, is only twice as large as that of the conventional barrel.

The vibratory barrel finishing apparatus disclosed in the Japanese Patent Publication No. 16558/1975 has a vibrator disposed at the center of the vibratory machine body. The finishing barrel has a corner angle which is a right angle or an acute angle and has a separating device projecting from the barrel body. Thus, this apparatus has an assymmetrical construction and, therefore, cannot be incorporated in a processing line. It is presumed that this apparatus cannot provide a satisfactory processing effect.

The Japanese Patent Laid-open Publication No. 141995/1978 states that "It makes possible to incorporate not single vibrator but a plurality of vibrator in the space extending along the length of the barrel." Judging from the above-statement, as well as from the attached FIGS. 1-9 and associated description which lacks a consideration of synchronized rotation of unbalanced weights, it is considered that the inventor of this invention has made a serious mistake. Namely, it is known that non-synchronized vibrations of a plurality of vibrators applied to the mass in the barrel causes a random movement of the mass or overflowing of the mass from the barrel. The aforementioned Japanese Patent Laid-open Publication No. 141995/1978 teaches how to overcome the above-mentioned problem by inclining the barrel wall outwardly. This, however, complicates the construction extraordinarily and causes a rise of the cost, as well as suppression of the finishing effect due to an obstruction of the flow of the mass.

SUMMARY OF THE INVENTION

It is, therefore, a major object of the invention to overcome the above-described problems of the prior art.

To this end, according to the invention, there is provided a vibratory finishing apparatus having an annular barrel constituted by two or more parallel straight sections and arcuate sections connecting these straight sections at their ends. The straight sections provide the desired length of the finishing line, while the arcuate end sections permit the circulation of the mass.

The movement of the workpiece is performed either by a restraining type system which employs a transfer device disposed along the barrel, or a non-restraining type system in which workpieces are immersed in the finishing media and are given a spiral movement. Thus, the workpiece performs different movements in these two systems which require different kinds of accessories. When the workpiece is comparatively soft and large, it is preferred to use the non-restraining type with an isolating member placed between each two adjacent workpieces.

Thus, according to the invention, an annular vibratory finishing apparatus is constituted by two or more parallel straight barrel segments and arcuate barrel segments which connect the straight segments at their ends, springs by which the annular barrel is mounted on a base for free vibration, and a vibrator disposed at the center of the longer axis of the annular barrel.

In the workpiece-restraining type apparatus of the invention, a guide box having a shape similar to that of the annular barrel is disposed above the latter. A rack for rotating the workpieces and a guide for guiding the housing of the spindle-chucked workpiece are mounted in the guide box. The housing of the spindle holds the spindle vertically and rotatably, and is provided with a mechanism for raising and lowering the spindle.

In the non-restraining type apparatus of the invention, workpiece charging and discharging sections are disposed above one of the end arcuate barrel segments of the annular vibratory barrel. The workpiece discharge section has a screen for separating the finishing material mass.

In a modification of the non-restraining type apparatus having isolating members, workpiece advance control plates are successively moved in a train so as to positively isolate the adjacent workpieces from each other.

BRIEF DESCRIPTION OF THE DRAWINGS

The above and other objects, as well as advantageous features of the invention will become clear from the following description of the preferred embodiments taken in conjunction with the accompanying drawings in which.

DESCRIPTION OF THE PREFERRED EMBODIMENTS

Various preferred embodiments of the invention will be described hereinunder with reference to the accompanying drawings.

Figure 1A:
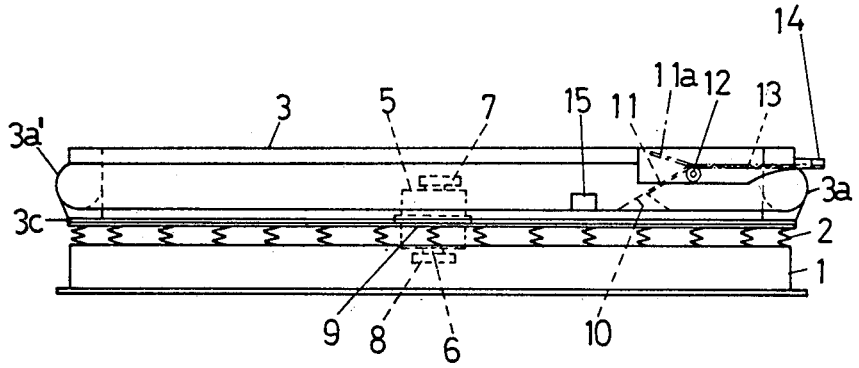
FIG. 1*a* is an elevational view of a non-restraining type line processing vibratory finishing apparatus which is an embodiment of the invention.
Figure 1B:
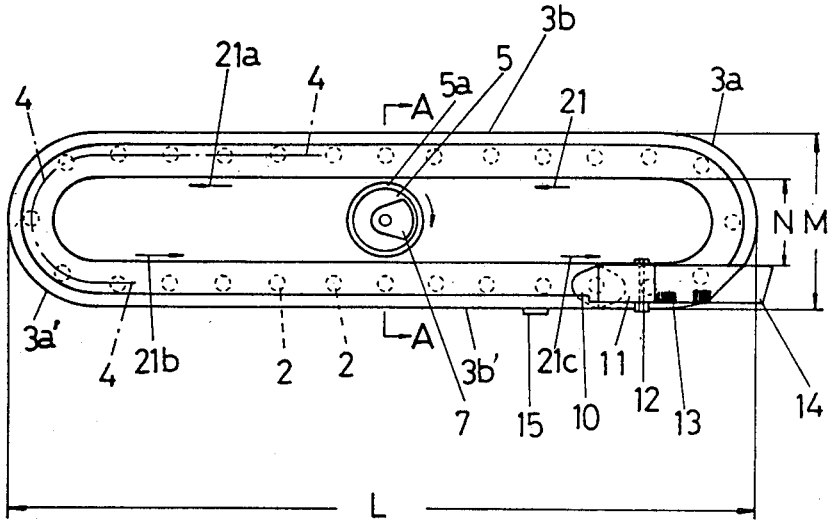
FIG. 1*b* is a plan view of the apparatus in FIG. 1*a;*

A finishing apparatus shown in FIG. 1*a* has a base 1 on which a plurality of springs 2 are disposed at a substantially constant pitch along the central line 4 shown in FIG. 1*b* for the barrel bottom so as to support an annular barrel 3 for free vibration. The barrel 3 has a length L which is several times, preferably 5 to 15 times as large as the diameter M of opposing semicircular barrel segments 3*a* and 3*a'*. A single vibrator 5 is disposed at the center of the barrel and fixed to a flange 9 in the central space N of the barrel 3. Unbalanced weights 7 and 8 are fixed to the upper and lower ends of a vertical shaft 6 of a motor, so that these weights 7 and 8 generate vibration as the vertical motor shaft 6 rotates.

For instance, assuming here that the unbalanced weights 7 and 8 are rotated clockwise as shown by the arrow in FIG. 1*b*, the mass moves counter-clockwise from the starting end of the barrel segment 3*a* to segment 3*b*, 3*a'* and 3*b'*, as denoted by arrows 21, 21*a*, 21*b* and 21*c*. The mass undergoes spiral flowing action in the barrel 3 as shown by the arrow in FIG. 1*c*, from the outer wall to the inner wall of the barrel 3 and vice versa repeatedly, during which the workpieces are finished or polished by finishing or polishing media. Since the elongated annular barrel 3 has a length L which is preferably 5 to 15 times as large as the diameter M of the annular barrel 3, if it is assumed here that the ratio M:L is 1:3 to 5, the lead angle of the upper and lower weights 7 and 8 are adjusted such that each workpiece completes one circuit in 3 to 10 minutes. The period is 10 to 30 minutes when the ratio M:L is 1:5 to 15, and 30 to 60 minutes when the ratio M:L is 1:15 to 30. Thus, a multiplicity of workpieces are processed successively in one cycle of operation. Such finishing time or period permits line processing.

An upwardly inclined stationary dam 10 and a rotatable flap 11 are shown in FIG. 1*a*, closed to the position denoted by numeral 11 or open to the position as denoted by 11*a* in FIG. 1*a*. Namely, the rotatable flap 11 opens and closes as it rotates around the rotary shaft 12 so as to continuously move the mass onto the screen 13 thereby to separate the workpiece from the finishing media. The separated workpiece is conveyed to the outside of the barrel 3 through the discharge port 14, whereas the separated finishing media which has passed through the screen 13 is recirculated in the barrel 3 for repeating the finishing operation on another workpiece. It is thus possible to continuously process the workpieces in a processing line. It is also possible to open the rotatable flap 11 to the position denoted by 11*a* in FIG. 1*a* to make the workpieces circulate repeatedly to be sure they are completely finished.

Figure 1C:
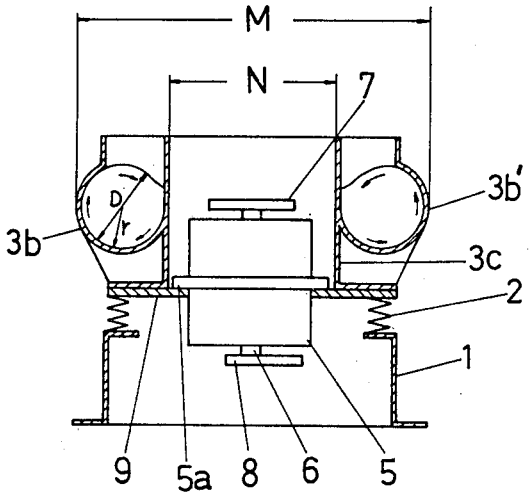
FIG. 1*c* is an enlarged sectional view taken along the line A—A of FIG. 1*b;*
Figure 2A:
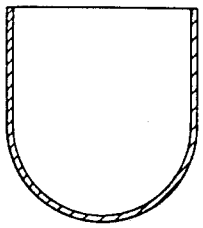
FIGS. 2*a*, 2*b*, 2*c* are sectional views of barrels made in accordance with the invention.
Figure 2B:
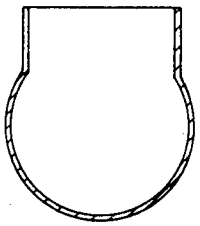
Figure 2C:
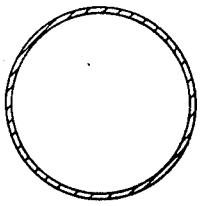

FIG. 1*c* is a sectional view taken along the line A—A of FIG. 1*b*, while FIGS. 2*a*, 2*b* and 2*c* show symmetrical barrels 3 similar to that of FIG. 1 and usable in the finishing apparatus of the invention.

The barrels 3 shown in FIGS. 2*a* and 2*b* have cross-sections which open at their upper portions, while FIG. 2*c* shows a fully-closed barrel 3. In the latter case, the upper part of the barrel 3 is open at the starting portion (portion corresponding to barrel segment 3*a* in FIG. 1*b* is open) to constitute the mass charging port. The end portion of the barrel 3 near the starting end, i.e. the portion between segments 3*b'* and 3*a* in FIG. 1*b* is partly open at its upper side for installation of accessories such as the upwardly inclined stationary dam 10, rotatable flap 11, and the screen 13 for the separation. Thus, the cross-sectional shapes of the barrels 3 shown in FIGS. 1*a*, 2*a*, 2*b* and 2*c* are used most appropriately in the annular barrel 3 of the finishing apparatus in accordance with the invention. It will be noted here that any other construction and shape of the barrel 3, such as those shown in the aforementioned Japanese Patent Publication No. 1655/1975 and Japanese Patent Laid-open Publication No. 141995/1978, do not suit the line processing and flowing motion of the mass as performed in the present invention very well. Namely, the barrel 3 of the invention has, along substantially its entire length, a cross-section which is symmetric and contacts the inner side of a circle of equal radius, so that the spiral flow of the mass takes place in quite a smooth manner.

Hereinafter, an explanation will be given as to why the non-synchronous vibration is eliminated in the apparatus of the invention. The barrel 3 of the apparatus of the invention is supported by springs 2 shown in FIGS. 1*a* and 1*b*. The springs 2 should be arranged at equal pitch along the central line 4 of FIG. 1*b* however the annular vibratory barrel 3 may be elongated. In addition, only one motor is fixed at its flange 5*a* to the support 9 at the center and mid-point of the annular barrel 3. In addition, the unbalanced weights 7 and 8 are fixed to the upper and lower ends of the vertical motor shaft 6 so as to be rotated with a suitable vibratory force and at a suitable lead angle, so that only one way three-dimensional vibration is generated by this vibrator. In consequence, the undesirable non-synchronous vibration is completely eliminated.

There are two types of long box type vibratory barrels heretofore used. One of the conventional systems employs a multiplicity of barrels connected in series, each barrel having one vibrator for generating vibration in a single dimension. The second type employs a plurality of weights for causing one-dimensional vibration connected to a single horizontal shaft or a plurality of shaft segments connected by means of joints, the shaft being disposed at the bottom of the barrel so that the weights are driven in synchronism to cause the vibration. Thus, conventionally, it has been considered that the use of a multiplicity of vibrators is essential even in the case of an annular barrel if the length of barrel is large. The arrangement shown in Japanese Patent Laid-open Publication No. 141995/1978 is based upon this misunderstanding. Namely, the three dimensional vibration is caused to be out of synchronism, unless the unbalanced weights are directed in the same direction and the vibrators are operated in perfect synchronism. Thus, it is quite difficult to obtain one way three-dimensional vibration unless the vibration is caused by only one vibrator.

It is also to be understood that the vibration effect differs considerably between a linear long-distance box-type barrel and an annular long-distance symmetrical barrel.

Figure 3A:
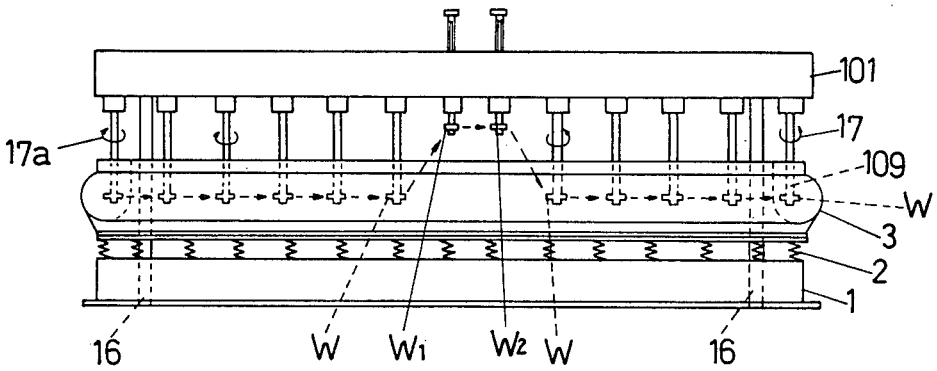
FIG. 3*a* is an elevational view of a workpiece-restraining type line processing vibratory finishing apparatus which is another embodiment of the invention.
Figure 3B:
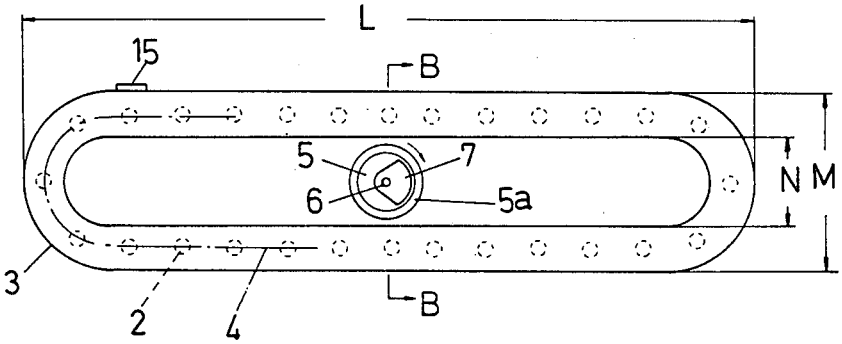
FIG. 3*b* is a plan view showing the positional relationship between the barrel and springs in the apparatus shown in FIG. 3*a;*
Figure 3C:
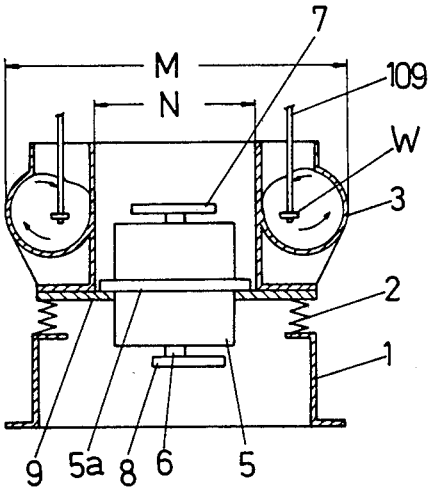
FIG. 3*c* is a sectional view taken along the line B—B of FIG. 3*a*, which a part of the apparatus removed.
Figure 3D:
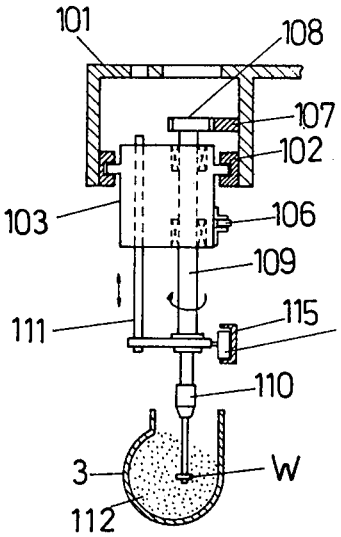
FIG. 3*d* is an illustration of the means for driving a spindle.
Figure 3F:
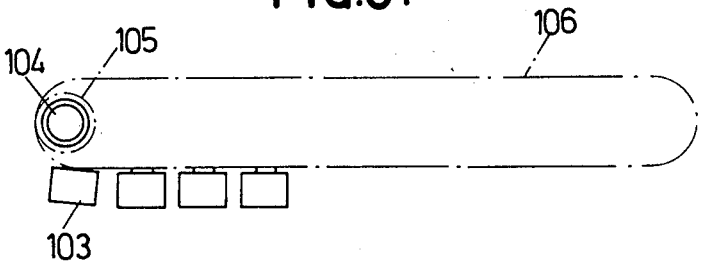
FIGS. 3*e*, 3*f*, 3*g* and 3*h* are exploded views of the housing for the spindle shown in FIG. 3*d;*
Figure 3E:
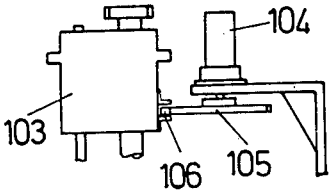
Figure 3G:
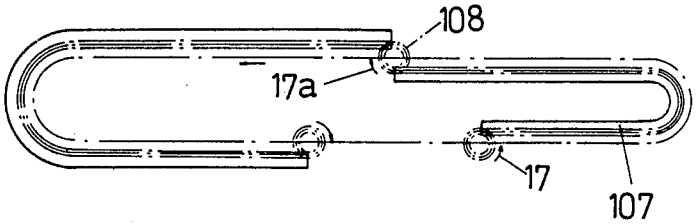
Figure 3H:
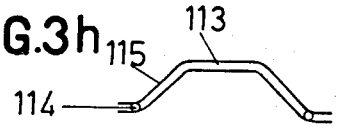

As shown in FIGS. 3*a*, 3*b*, 3*c*, 3*d*, 3*e*, 3*f*, 3*g* and 3*h*, supports 16 are disposed at both ends of the central space of the barrel 3, and a guide box 101 is mounted on these supports 16. The guide box 101 accommodates a guide 102, shown in FIG. 3*d* only, having a groove which slidably receives housings 103 for spindles 109. The housings 103 are connected to a chain 106 which engages a sprocket wheel 105, shown in FIG. 3*e* only, fixed to the shaft of a driving motor 104. The spindle 109, best shown in FIG. 3*d*, is attached vertically to the housing 103 for free rotation. A pinion 108, engaged with a rack 107 in the housing 103, is fixed to the upper end of each spindle 109, while a workpiece W to be finished is chucked to the lower end of the spindle 109 by a chuck 110. In FIG. 3*d*, reference numeral 114 denotes a roller for guiding a vertical movement of the spindle 109, 115 denotes a roller guide, and 111 denotes a guide rod. Therefore, as the housing 103 is moved by means of the chain 106, the spindle 109 is rotated by engagement of the rack 107 with the pinion 108, so that the workpiece W is rotated in the finishing media 112.

The workpiece W is rotated in one or the other direction as denoted by arrow 17 or 17*a* of FIG. 3*a*, and is moved in the finishing media 112 as shown in FIGS. 3*a* and 3*d*. In the positions W1 and W2, the workpiece W is raised so that the finished workpiece W can be unchucked from the spindle 109 and a new workpiece W to be finished is chucked to the spindle 109.

The direction of transfer may be either the forward direction in relation to the spiral movement of the finishing media 112 or may be reverse to the latter. In the latter case, it is possible to effect a heavier processing.

Hereinafter, a description will be given of the chucking and unchucking of the workpiece W, with specific reference to FIGS. 3*d* and 3*n*. As the spindle 109 and the housing 103 are moved to a workpiece chucking station 113, the spindle 109 stops rotating and the roller 114 rolls upward along the groove or workpiece chucking station 113 of the roller guide 115, thereby lifting the spindle 109 to completely remove the workpiece W from the finishing media 112. In the period in which the spindle 109 is held at the same level as the roller guide 115, i.e. in the period between positions W1 and W2 of FIG. 3*a*, the workpiece W is released from the chuck 110 and a new workpiece W to be finished is attached to the chuck 110 instead. Then, the roller guide 115 is lowered to move the new workpiece W into the barrel 3. The pinion 108 of the spindle 109 is again brought into engagement with the rack 107 to cause the rotation of the spindle 109, thereby carrying out the processing in the barrel 3.

The chucking and unchucking of the workpiece W to and from the spindle 109 can be carried out manually or mechanically making use of a combination of a loader and unloader. The rack 107 may be toothed internally over its left half part and externally over its right half part. By so doing, the rotation of the spindle 109 is switched such that a clockwise rotation is made when the spindle 109 moves along the left half part of the rack 107, and a counter clockwise rotation is made when it moves along the right half part of the rack 107, thereby uniformly finishing the workpiece W.

FIGS. 4 and 5 show an annular vibratory barrel finishing apparatus which is constructed to permit line processing of a workpiece Wa which is comparatively large and soft and, hence, liable to be damaged or distorted. A guide box 25 is mounted above the upper opening of the annular barrel 3. The guidebox 25 accommodates control plate shaft housings 29, workpiece advancing and controlling plates 32, a driving chain 33, best shown in FIGS. 5*a* and 5*b*, and a roller guide 35, shown only in FIGS. 5*a* and 5*b*, for moving up and down the workpiece advancing and controlling plates 32. The workpiece advancing and controlling plates 32 conveniently prevent the mutual interference between adjacent workpieces Wa. Referring first to FIG. 4*a* showing this embodiment of the invention in elevation, a vibratory motor 5 is placed at the central mid point of the vibratory barrel 3. Unbalanced weights 7 and 8 are fixed to the upper and lower ends of the vertical shaft of the motor 5. As the vertical motor shaft rotates, one way three-dimensional vibration having no non-synchronous vibration is generated to vibrate the finishing media in the barrel 3, so that the workpieces Wa are finished as they move within the barrel 3. In FIG. 4*d*, the arrow 23 represents the direction of spiral flow of the mixture of workpiece Wa and finishing media. This barrel 3 is equipped with an upwardly inclined stationary dam 10, rotatable flap 11, screen 13, workpiece discharge port 14, media discharge port 15, and a workpiece charging port 19 which are known per se. The workpieces Wa are placed through the workpiece charging port 19 in the direction of arrow 20, and are moved successively into the barrel 3, running over the rollers 34 which are inclined downwardly toward the barrel 3. More specifically, as will be seen in FIGS. 5*i* and 5*j*, a hydraulic cylinder 27 is actuated as the controlling plate 32 abuts a limit switch 24 so that member 28*a* is lowered to cause the workpiece Wa to move into the barrel and the succeeding workpieces Wb, Wc . . . are moved successively into the barrel 3. The controlling plates 32, as shown in FIG. 5*i*, drive the successive workpieces Wa, Wb along barrel 3 while isolating the adjacent workpieces Wa, Wb from each other, so that the undesirable mutual interference between the adjacent workpieces Wa, Wb is avoided so as to prevent damage or distortions of the workpieces Wa, Wb. Each workpiece Wa, Wb is circulated through the barrel 3 as shown by arrow 23 in FIG. 5*i* and automatically discharged through the discharge port 14, so that it is possible to effect line processing on a large number of successive workpieces Wa, Wb.

Figure 4A:
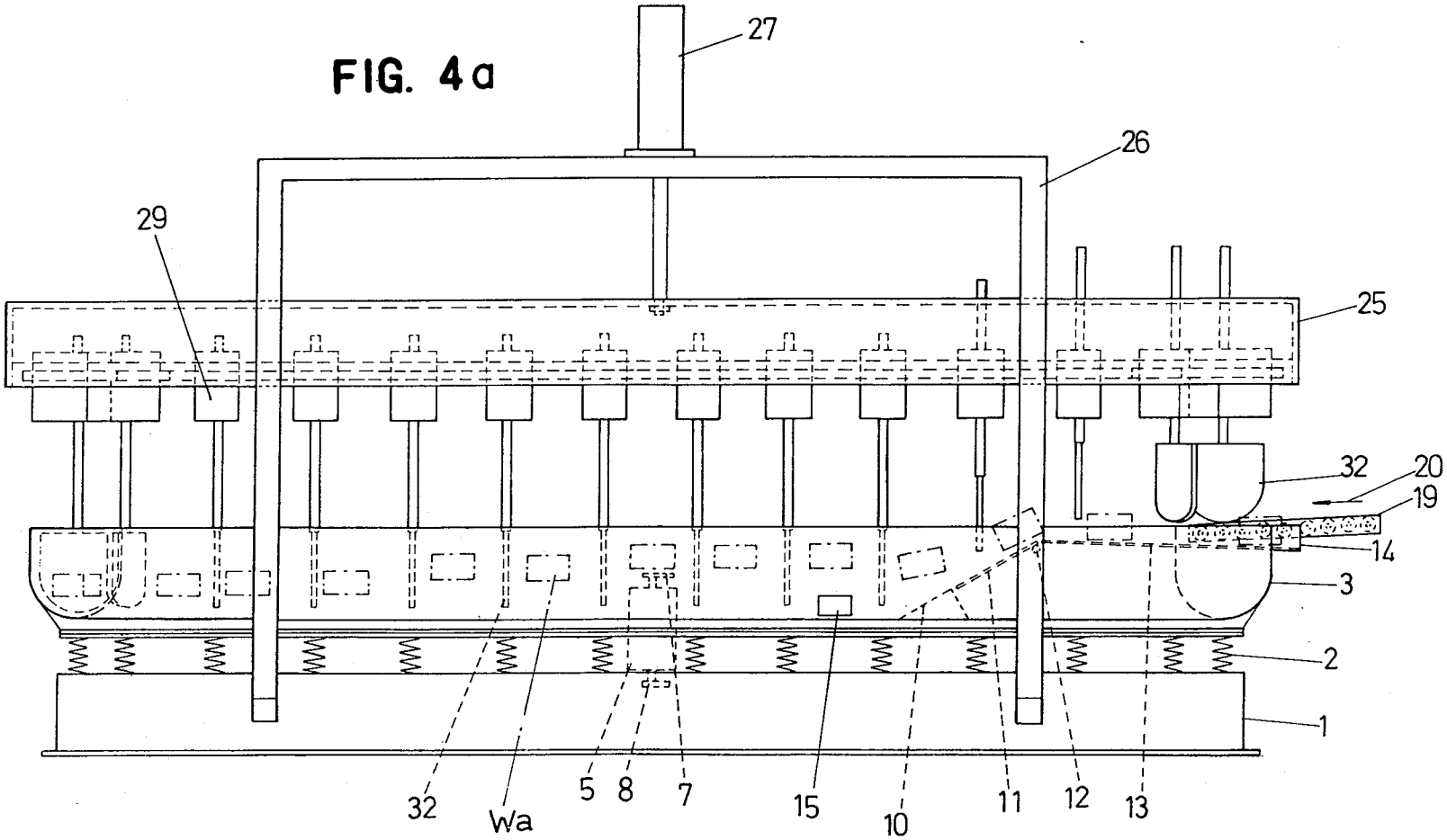
FIG. 4*a* is an elevational view of a line processing long-travel vibratory finishing apparatus having workpiece advancing and controlling plates, constructed in accordance with still another embodiment of the invention.

Needless to say, the workpiece advancing and controlling plate 32 has to have a configuration which fits well in the cross-section of the barrel 3, in order that the plates 32 move smoothly along the inner wall of the barrel 3. Generally, a U-shaped controlling plate 32 is used in a barrel 3 having a U-shaped cross-section as shown in FIG. 4*a*. Also, a controlling plate having a shape denoted by 32*a* can be used in combination with a barrel segment 3*a* shown in FIG. 4*c*. In order that the plate 32*a* will clear the wall of the barrel segment 3*a* when it is lifted above the latter, the inner surface of the outer wall of the barrel 3 is spread at dam 10, flap 11, and screen 13 shown in FIG. 4*c*.

Figure 4B:
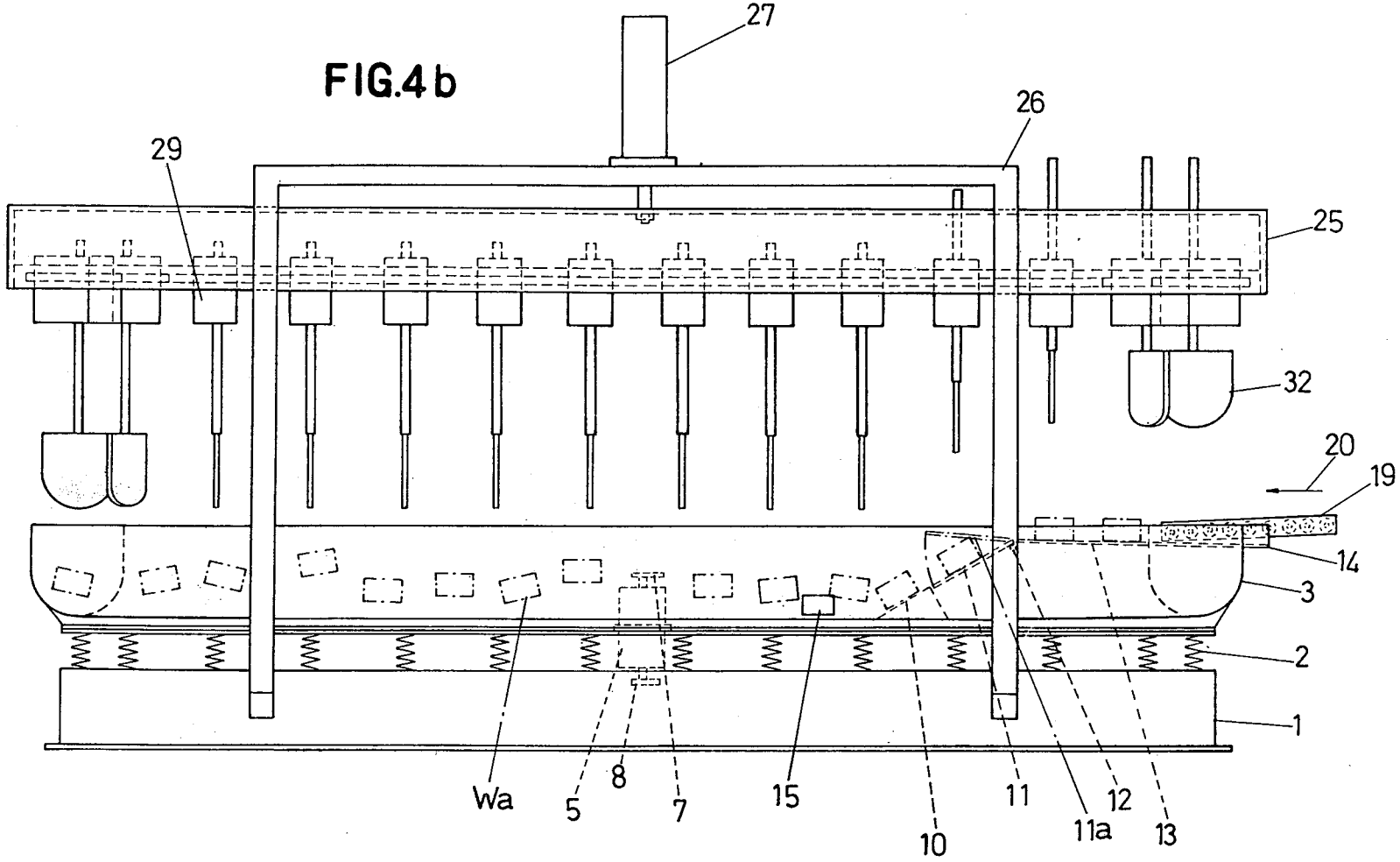
FIG. 4*b* is an elevational view of the apparatus shown in FIG. 4*a* showing the manner of suspending the workpiece advancing and controlling plates.
Figure 4C:
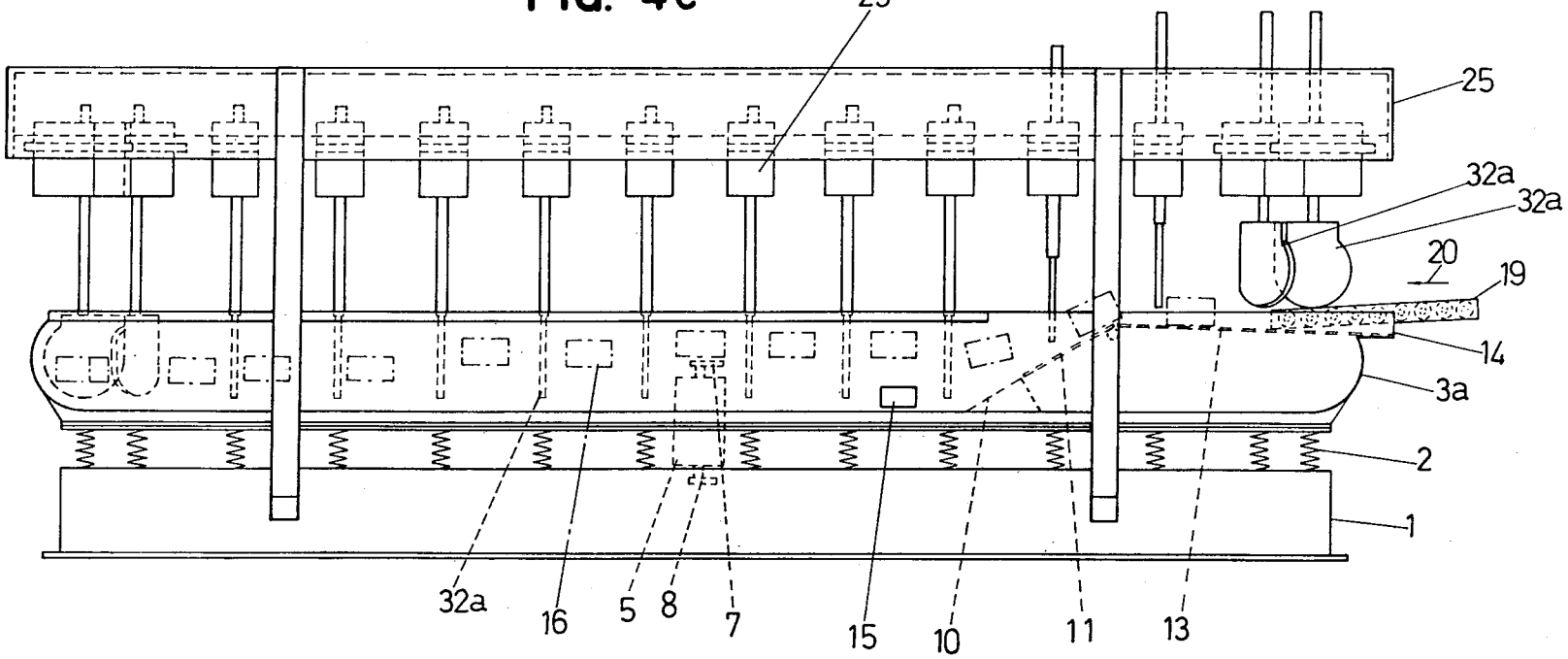
FIG. 4*c* shows a modification in which the inner peripheral surface of the outer wall of the barrel is projected inwardly.
Figure 4D:
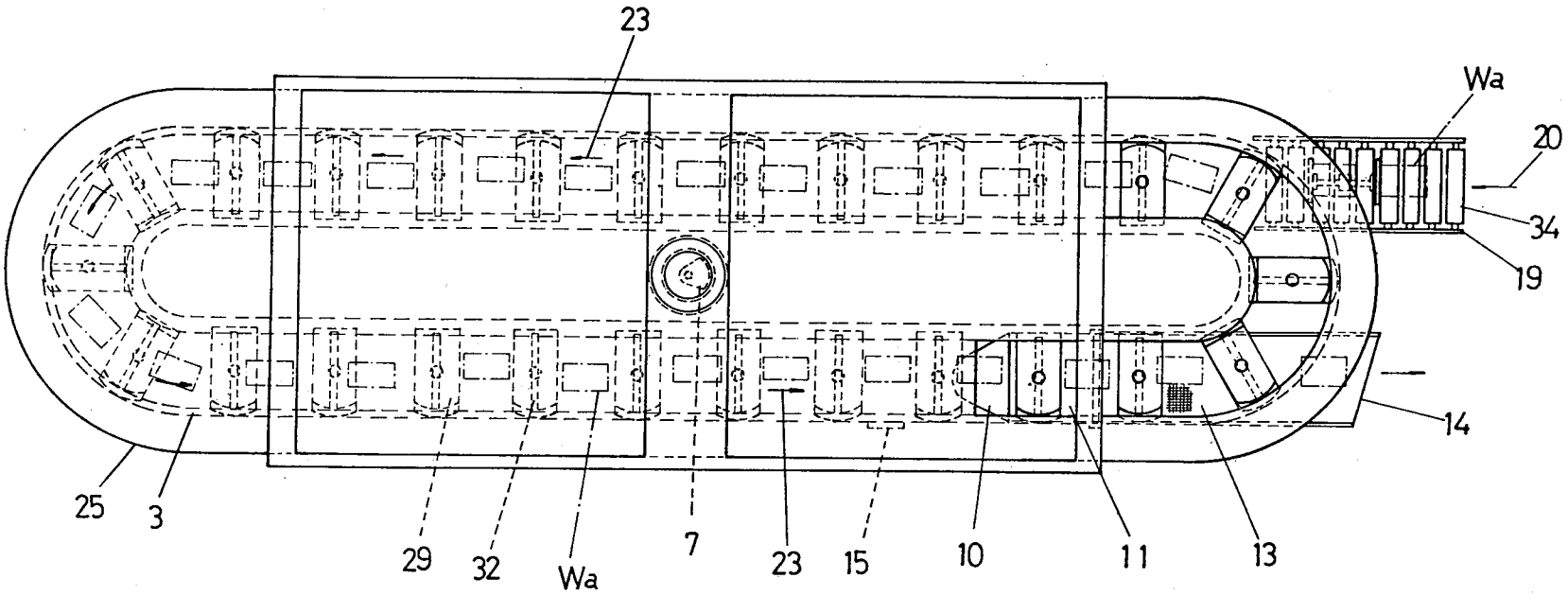
FIG. 4*d* is a plan view of the embodiment shown in FIG. 4*c;*
Figure 5B:
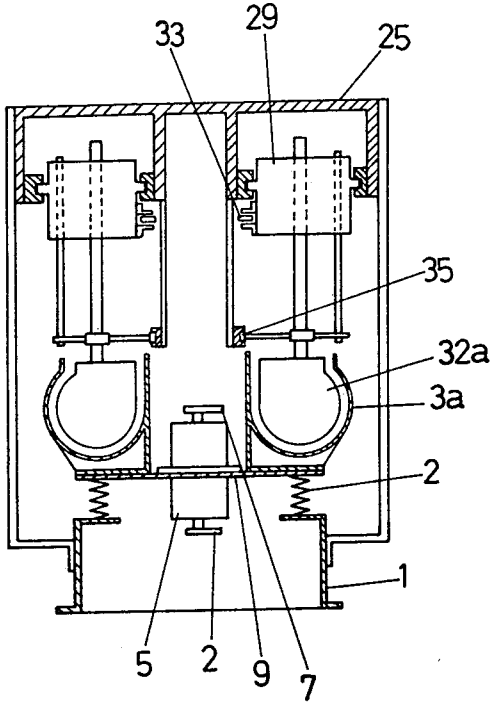
FIG. 5*b* is a longitudinal sectional view of the apparatus shown in FIG. 4*c;*
Figure 5A:
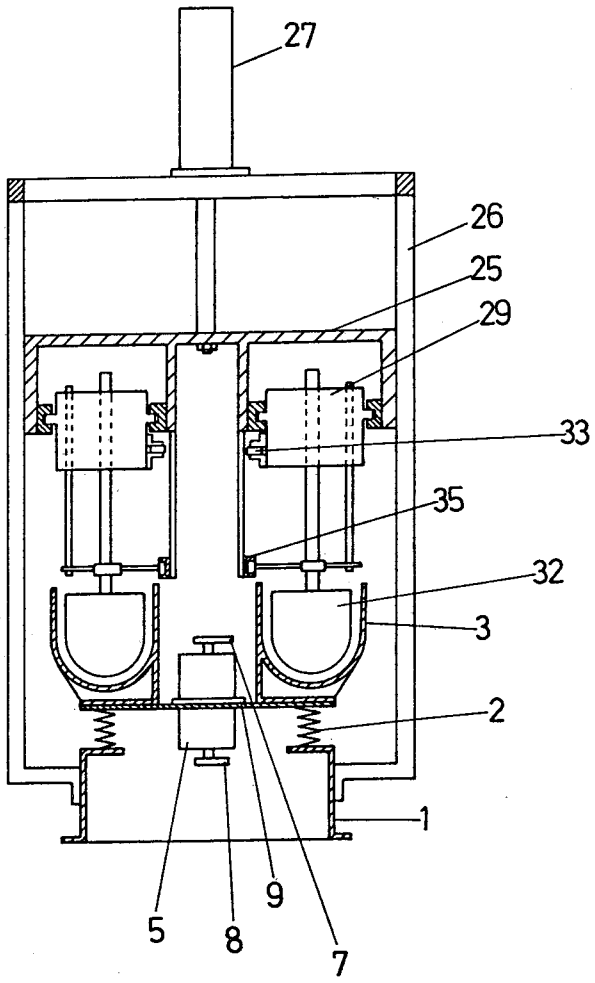
FIG. 5*a* is a longitudinal sectional view of the embodiment shown in FIG. 4*a;*
Figure 5C:
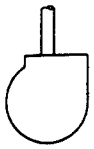
FIGS. 5*c*, 5*d*, 5*e*, 5*f*, 5*g* and 5*h* are illustrations of different forms of a control plate.
Figure 5D:
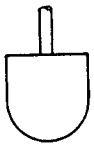
Figure 5E:
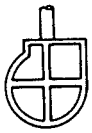
Figure 5F:
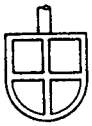
Figure 5G:
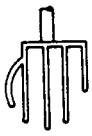
Figure 5H:
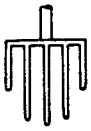

In the case of small or medium-size workpieces Wa which do not interfere with each other so that the controlling plates 32 are unneccesary, the guide box 25 is suspended by a hydraulic cylinder 27, best shown in FIG. 5*a* and disposed at the center of the space between the supports 26 provided at both sides of the central vacant space above the barrel 3. The controlling plates 32 and other members are lifted outside of the barrel 3. The rotatable flap 11 is situated at a position 11*a*, shown in FIG. 4*b*, and the workpieces Wa are introduced through the charging port 19. As a result, the workpieces Wa undergo spiral movement in the direction of arrow 23 in FIG. 4*d* so as to be circulated for a desired time for a satisfactory finishing.

After the finishing operation, the rotatable flap 11 is reset at the position shown in FIG. 4*b*, so that the workpieces Wa are discharged automatically over the screen 13 to the workpiece discharge port 14. It is thus possible to finish a large number of workpieces Wa. If a satisfactory finishing effect is obtained by only one circulation in the barrel 3, the workpieces Wa are successively line-processed, with the rotatable flap 11 being disposed at the position shown in FIG. 4*b*.

Figure 5I:
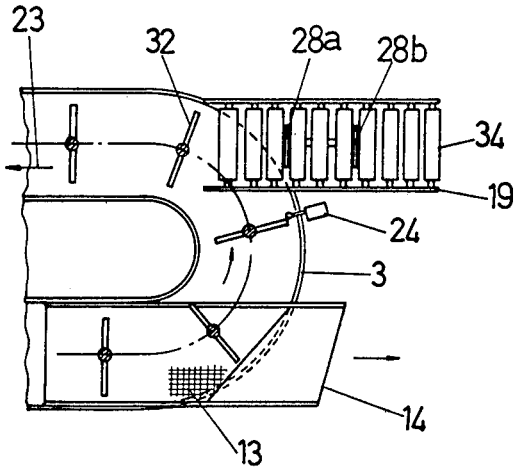
FIG. 5*i* is a plan view of the portion of the apparatus shown in FIG. 5*c* near the workpiece charging port.
Figure 5J:
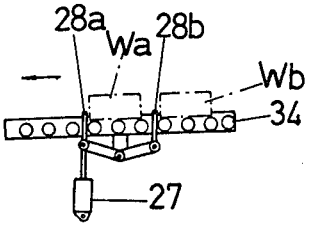
FIGS. 5*j*, 5*k*, and 5*l* are illustrations of the operation of the workpiece charge control device.
Figure 5K:
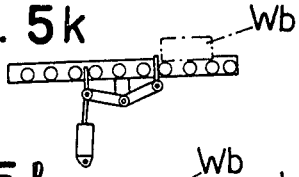
Figure 5L:
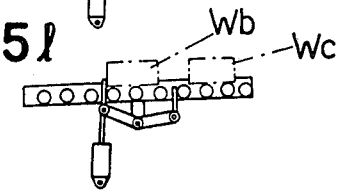
Figure 5M:
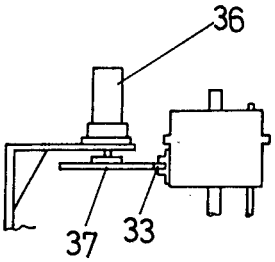
FIG. 5*m* is an elevational view of a driving device for the controlling plates.
Figure 5O:
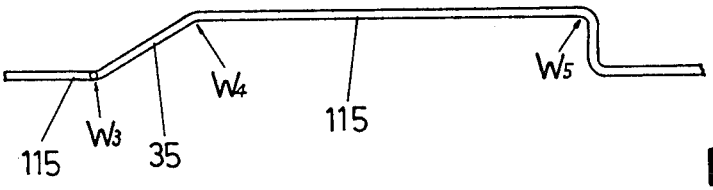
FIG. 5*o* is a developed view taken along the line C–D of FIG. 5*n;*
Figure 5N:
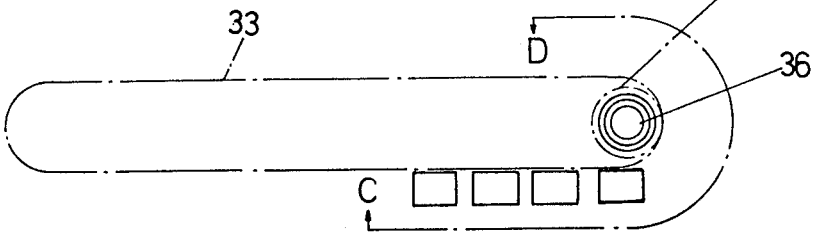
FIG. 5*n* is a schematic partial plan view of the device shown in FIG. 5*m;*

The workpiece advancing and controlling plates 32 are placed in the finishing media as shown in FIG. 4*a* to process the workpieces Wa, and are lifted at a region between positions W3 and W4 of FIG. 5*o* so as to forward the workpieces Wa toward the discharge port 14 shown in FIG. 5*i*. At a position W5 of FIG. 5*o*, the workpiece advancing and controlling plates 32 of FIG. 5*i* are lowered into the finishing media to control the movement of the workpieces Wa and Wb of FIGS. 5*i*–5*l* as they are charged through the charging port 19 of FIG. 5*i*. The controlling plates 32 are adapted to be driven by a chain 33, as shown in FIG. 5*m*, which is connected to the control plate shaft housings 29 of FIG. 5*b* and which also engages a sprocket wheel 37 of FIG. 5*n* fixed to the shaft of a driving motor 36. It is possible to locate the vibratory motor 36 at one end of the central open space of the barrel 3 while situating a vibrator 5 shown in FIGS. 4*a*–4*c* at the other end of the central open space of the barrel 3, the vibrator 5 being adapted to be operated in synchronization with the vibratory motor 36 through a chain 33 of FIG. 5*m* or a timing belt which interconnects the vibratory motor 36 and the vibrator 5. It is also possible to install and synchronously drive 4 to 5 vibrators 5 at one time by a similar method.

Unbalanced weights 7 and 8 at a predetermined lead angle and having a predetermined vibration power are fixed to the upper and lower ends of the vertical rotary shafts 6 of FIG. 3*c* of the vibrator 5 and the vibratory motor 36. These rotory shafts 6 are rotated at a speed of 1500 to 1800 r.p.m. in the same direction, thereby finishing the workpieces W in the barrel 3 as is known per se.

An explanation will be given hereinunder of a different embodiment of the invention in which there is provided a plurality of barrels 3, with specific reference to FIGS. 6*a* and 6*b*. This apparatus has two semicircular barrel segments 133 and 233 at each end between which there are connected four straight barrel segments 3*b* and 3*b*', as shown in FIG. 1*b*, thereby constituting concentric long-travel annular barrels 3 which together form a barrel structure. On each side of the barrel 3, there are are springs 2 interposed between the barrel bottom and the base 1 of the apparatus, along the boundary line between the adjacent barrels 3, so as to support the whole barrel structure. A single vibratory motor 5 is disposed at the central mid point of the barrel 3.

Figure 6A:
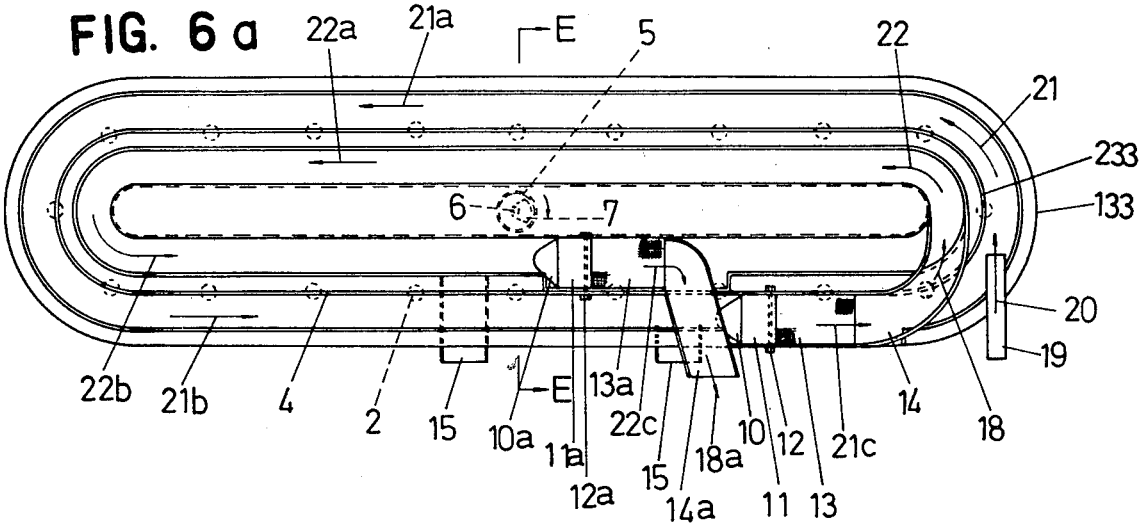
FIG. 6*a* is a plan view of an embodiment of the invention having a plurality of barrels connected in series.
Figure 6B:
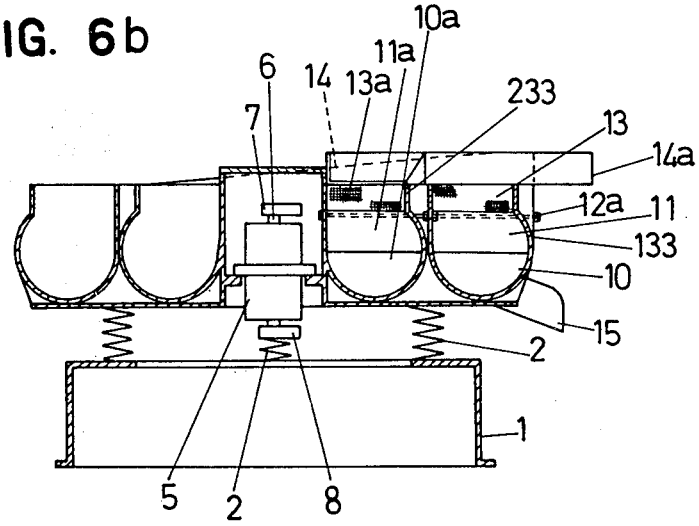
FIG. 6*b* is a sectional side elevational view taken along the line E—E of FIG. 6*a;*

Preferably, media for rough finishing is charged into the outer barrel segment 133 of FIGS. 6*a* and 6*b*, whereas the inner barrel segment 233 is charged with media for fine finishing. The workpiece W is introduced first into the outer barrel segment 133 through the charging port 19 as represented by arrow 20. Flow directions are denoted by arrows 21, 21*a* and 21*b*. After the rough finishing operation, the workpieces W pass over a separating device constituted by an upwardly inclined stationary dam 10, rotatable flap 11, screen 13, and the workpiece discharge port 14. The separated rough-finished workpieces W are then introduced by port 14 into the inner barrel segment 233 as shown by arrow 18. The workpieces W then move in the fine finishing media as denoted by arrows 22, 22*a* and 22*b* so as to be finished finely. The workpieces W then flow over a separating device constituted by an upwardly stationary dam 10*a*, rotatable flap 11*a*, screen 13*a* and workpiece discharge port 14*a* and are separated from the finishing media as shown by arrow 22*c*. The workpieces W then flow out of the barrel 3 as shown by arrow 18*a*. Meanwhile, there is no exchange of finishing media between the inner and outer barrel segments 133 and 233, so that no mixing of the rough and fine finishing media with each other takes place. Therefore, a multiplicity of workpieces W can be subjected first to a rough finishing and then to a fine finishing or first to a wet finishing performed by a wet finishing media with compound solution and then to a dry finishing with a dry media, and are finished at a high rate of one workpiece W per several seconds.

In the event that the workpieces W require a long finishing time, the outer and inner barrel segments 133 and 233 can be charged with the same finishing media so that the apparatus is given a doubled barrel length, i.e. a doubled finishing time, making it possible to perform the desired finishing operation in a smaller space than if two separate devices were used. If the workpiece discharge ports 14 and 14*a* of the inner and outer barrel segments 233 and 133, respectively, are directed into another barrel 3, the apparatus can finish two kinds of workpieces W with the same or different finishing media.

Figure 7A:
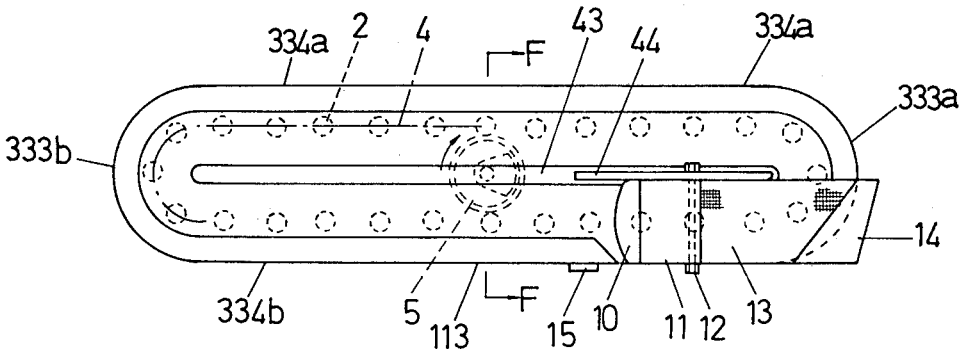
FIG. 7*a* is a plan view of an apparatus embodying the invention in which a vertical side wall is provided at one end of a linear protrusion running along the center of the barrel, and in which an upwardly inclined stationary dam, rotatable flap, and a separating device are provided.
Figure 7B:
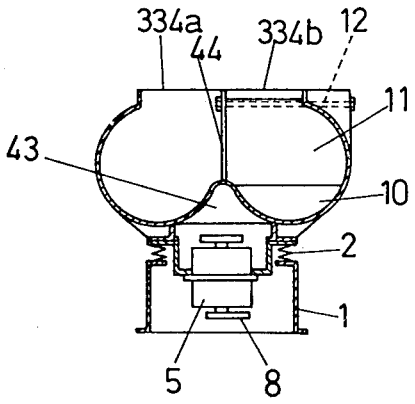
FIG. 7*b* is an enlarged sectional view taken along the line F—F of FIG. 7*a;*
Figure 7C:
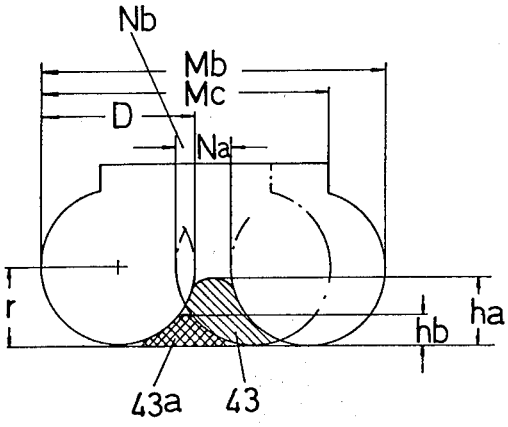
FIG. 7*c* is an enlarged illustration of the shape and size of the protrusion at the section along the line F—F of 7*a;*

FIG. 7*a* shows a different embodiment in which an elongated barrel 3 is provided with an upward protrusion 43 placed along the center of the elongated barrel 3. The outer walls of opposing arcuate barrel wall segments 333*a* and 333*b* are unitarily connected by straight barrel wall segments 334*a* and 334*b*. Alternatively, as shown in FIG. 7*c*, an upward linear protrusion 43 or 43*a* is disposed along the center of the barrel 3. The cross-section of the barrel 3 transverse to its length has two circular portions, and the surfaces of the protrusion 43 or 43*a* facing the interior of the barrel 3 have circular profiles which are continuations of the interior surface of the barrel 3. The protrusion 43*a* and 43 of FIG. 7*c* has a height ha or hb, respectively, smaller than the radius r of the circular portions on the inside of the cross-section of the barrel 3, while the distance Na between vertical tangents to continuations of the curvature of the inner walls is substantially less than ⅓ of the barrel diameter D, where said continuations do not intersect. The distance Nb between the vertical tangents, where the continuations do intersect, is no greater than 1/6 of the barrel diameter D (See FIG. 7*c*). In the barrel 3 having such an elongated shape, the forcible biting of the mass on the inner side of the barrel 3 is avoided to ensure quite a soft and precise line processing. FIG. 7*b* is a sectional view taken along the line F—F of FIG. 7*a*. The vibratory motor 5 is fixed to the center mid point of the barrel bottom, as shown in FIG. 7*b*.

The line processing as shown in FIGS. 1*a* and 1*b* can be achieved solely by the use of the aforementioned protrusion 43 or 43*a*. It is also possible to modify this embodiment by providing a vertical side wall 44 along one end or along the entire length of the protrusion 43 or 43*a*. In such a case, the separation section for separating the workpieces W from the media is constituted by arranging the upwardly inclined stationary dam 10, rotatable flap 11 with shaft 12, screen 13, and workpiece discharge port 14 along this vertical side wall 44.

It is further possible to obtain a soft and light-load line processing by disposing the workpiece transportation or transfer device as described in connection with FIGS. 3*a*–3*b* over the upper opening of the annular vibratory barrel 3 as described above for the embodiment of FIGS. 7*a*–7*c* which has the protrusion 43 or 43*a* therein.

According to the invention, it is possible to use the vibratory motor 5 itself as the vibrator or to drive a single vibrator by two motors for increasing the vibration force. In the case of the annular vibratory barrel 3 having a substantial length as in the invention, however, it is preferred to use only one vibrator 46 in order to obtain a single and sole three dimensional vibration, as is the case with the vibratory motor 45.

Figure 8A:
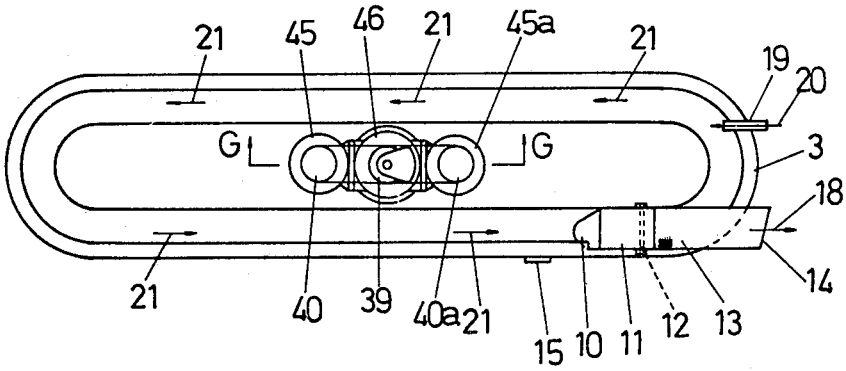
FIG. 8*a* is a plan view of an embodiment of the invention in which a vibrator is driven by a motor.
Figure 8B:
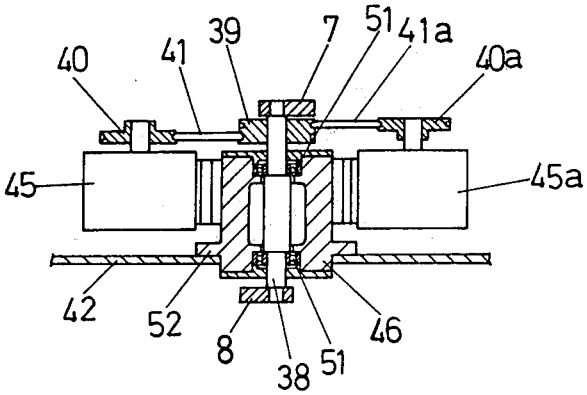
FIG. 8*b* is a sectional view taken along the line G—G of FIG. 8*a;*

In order to meet this requirement, the motors 45 and 45*a* for driving this vibrator 46 are disposed on both sides of the vibrator 46 at an equal distance from the latter, as shown in FIGS. 8*a* and 8*b*, i.e. in symmetry with each other with respect to the vibrator 46, and parallel with the straight sections 334*a* and 334*b* of the barrel 3 in FIG. 7*a*. The vibrator 46 or the vibratory motor 45 is placed on the bottom plate 42 of FIG. 8*b* at the center of the barrel 3. The shaft 38 of the vibrator 46 is driven by means of the belts 41, 41*a* which go around the motor pulleys 40, 40*a*. The vibrator 46 is fixed by means of a bracket 52 on the bottom plate 42 which covers the central space of the barrel 3. Unbalanced weights 7 and 8 are fixed to the upper and lower ends of the shaft 38 so as to be rotated and to produce the vibration force. Reference numerals 51 denote roller bearings for the shaft 38. Since seizure of the roller bearings 51 may result if the shaft 38 has a large diameter, it is necessary to use roller bearings 51 in place of a spray type lubrication system. Although the barrel 3 of the apparatus of invention has a large size, it is not always necessary to employ two motors 45 and 45*a*, and the apparatus of the invention can operate satisfactorily with a single vibratory motor 45 or 45*a* if the unbalance caused by the location of the motor 45 or 45*a* and other factors is small.

It is possible to increase the vibration force by disposing a plurality of vibrators 46 along a line extending along the longitudinal center of the long-travel annular vibratory barrel 3. In this case shown in FIG. 9*a*–9*c*, a plurality of vibratory motors 45, 45*a*, and 45*b* are provided with unbalanced weights 7*a*, 8*a*, 7*b*, 8*b*, 7*c*, and 8*c* mounted on the upper and lower ends of the vertical motor shafts 47*a*, 47*b*, and 47*c* at an equal lead angle and for producing an equal vibration force. These weights 7*a*–8*c* are directed in the same direction and are adapted to be rotated in synchronization. Sprockets 48*a*, 48*b*, 48*c*, and 48*d* fixed to the aforementioned plurality of vertical motor shafts 47*a*, 47*b*, and 47*c* are adapted to be driven by chains 50*a* and 50*b*, as shown in FIGS. 9*b* and 9*c*, or the pulleys are driven through timing belts. In FIG. 9*b*, $\theta a$, $\theta b$, and $\theta c$ represent the lead angles of the weights 7*a*, 7*b*, and 7*c*, respectively.

Figure 9A:
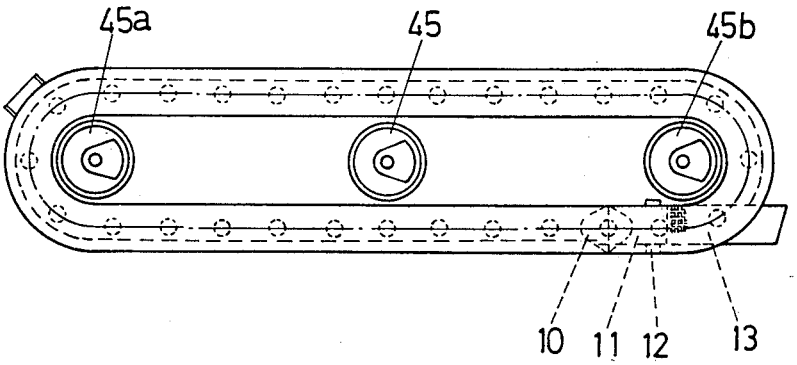
FIG. 9*a* is a plan view of an embodiment of the invention in which a plurality of pairs of vertically unbalanced weights are attached to vertical shafts of a plurality of vibrators and the weights are driven in the same direction in synchronism.
Figure 9B:
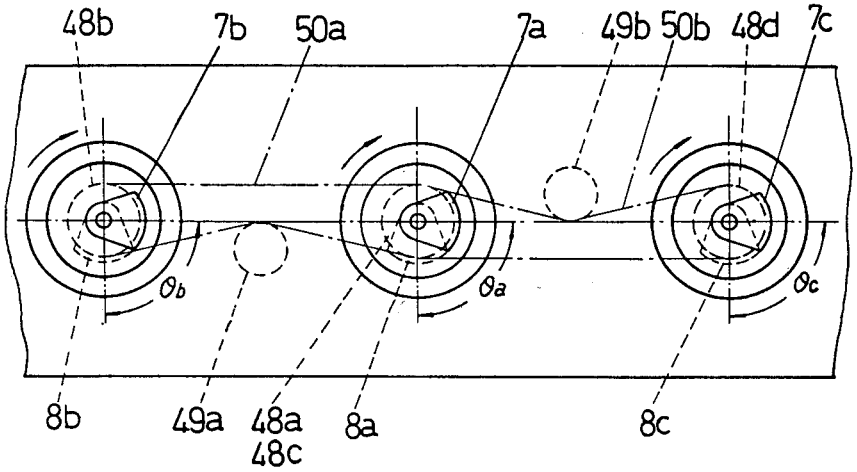
FIG. 9*b* is an enlarged plan view showing a driving device.
Figure 9C:
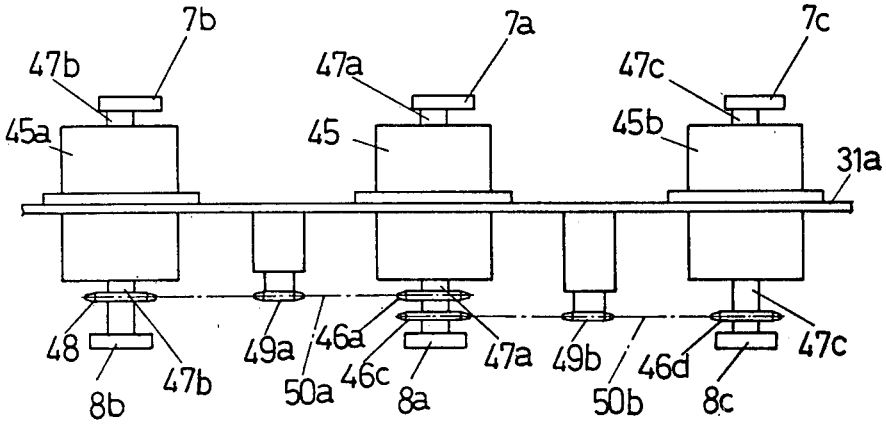
FIG. 9*c* is an enlarged front elevational view of the driving device of FIG. 9*b*.

FIG. 9*a* shows a vibratory barrel finishing apparatus of the invention having three vibratory motors 45, 45*a*, and 45*b*. Referring to FIG. 9*b*, vibratory motors 45*a* and 45*b* are disposed on a line on the bottom plate in the central opening of the barrel 3 on opposite sides of a vibratory motor 45 disposed at the center of the barrel 3. Unbalanced weights 7*a*, 8*a*, 7*b*, 8*b*, 7*c*, and 8*c* having a predetermined lead angle $\theta$ and producing a predetermined vibration force are mounted on the upper and lower ends of the vertical shafts 47*a*, 47*b*, and 47*c* of these vibratory motors 45, 45*a*, and 45*b*. These shafts 47*a*, 47*b* and 47*c* are provided with sprockets or pulleys 48*a*, 48*b*, 48*c* and 48*d* so as to be rotated in synchronism by means of chains 50*a* and 50*b* or timing belts.

The embodiments and modifications of the invention heretofore described provide a reasonable, simple and wasteless vibratory barrel finishing apparatus having a long-travel annular barrel 3 suitable for use in line-processing of workpieces W. Thus, the invention offers a great advantage that barrel finishing such as grinding can be effectively incorporated in a processing line to remarkably improve the operation efficiency of the line as a whole. In addition, the invention can be embodied in various ways such as finishing by mixing the workpieces W with the finishing media 112 or by suspending the workpieces W in the finishing media 112. The way of finishing, therefore, can suitably be selected in accordance with the nature of the workpiece W.

What is claimed is:

1. A long travel vibratory barrel finishing apparatus for line processing of workpieces to be finished, said vibratory finishing apparatus comprising:

an elongated vibratory barrel having two opposed semicircular barrel outer wall segments and straight barrel outer wall segments extending therebetween to form an oval path, said barrel having a length from 5 to 15 times the width in the direction transverse to the straight barrel outer wall segments, and said barrel having a cross-section transverse to the length thereof which is symmetrical about the center of the cross-section and at least the lower part of which is substantially circular and which is open at the top thereof;

a plurality of springs supporting the bottom of said vibratory barrel and extending along the bottom of the barrel in a line generally parallel to the axis of the circular cross-sectional portions;

a vibrator at the center of said barrel having a vertical rotary shaft and having unbalanced weights on the upper and lower ends of said rotary shaft at a predetermined angle to each other around the axis of the shaft for producing a predetermined vibration force during rotation of said shaft;

guide means positioned above said vibratory barrel and extending around the entire perimeter of said oval path;

a plurality of workpiece supporting spindles depending from said guide means into said vibratory barrel, said spindles having workpiece holding means on the lower ends thereof within said barrel and being vertically slidable in said guide means;

means for sliding said spindles upwardly in order to raise finished workpieces completely out of said vibratory barrel before removing and replacing such finished workpieces from the lower ends of the spindles; and spindle drive means connected to said spindles for moving the spindles along said guide means and simultaneously for rotating the spindles around the longitudinal axes thereof.

2. An apparatus as claimed in claim 1 in which said guide means comprises a guide box extending along and above said vibratory barrel and a spindle housing member for each spindle, said housing member being slidably guided along said guide box.

3. An apparatus as claimed in claim 1 in which said spindle drive means comprises a chain extending along said guide means and connected to each spindle, motor means connected to said chain for driving said chain along said guide means, a pinion on each spindle, and a rack means extending along the path of movement of the spindles along said guide means with which each pinion is engaged for rotating each of said spindles as said spindles are moved along said guide means.

4. An apparatus as claimed in claim 3 in which said rack means comprises a first rack extending along the inside of the path of each pinion as said spindles are moved along said guide means for rotating said spindles in one direction, and a second rack extending along the outside of the path of the pinions for rotating said spindles in the opposite direction as said pinions are moved along said guide means.

5. An apparatus as claimed in claim 1 in which the cross-section of said barrel has a first wall in the upper portion of the barrel and on the inner side of the barrel extending vertically and a second wall in the upper portion of the barrel and on the outer side of the barrel curved circularly inwardly and then extending vertically upwardly.

6. An apparatus as claimed in claim 1 in which the cross-section of said barrel has a wall in the upper portion of the barrel and on the inner and outer sides of the barrel extending vertically.

7. An apparatus as claimed in claim 1 in which the cross-section of said barrel has walls in the upper portion of the barrel and on the inner and outer sides of the barrel curved circularly toward each other and then vertically upwardly.

8. An apparatus as claimed in claim 1 in which said vibrator comprises a housing connected to said barrel and in which said shaft is mounted, and two motors mounted on diametrically opposite sides of said housing and which are connected to said shaft for driving said shaft.

9. An apparatus as claimed in claim 1 in which said vibrator comprises a motor, the output shaft of said motor constituting said rotary shaft, said vibrator being substantially midway of the length of said vibratory barrel, and said apparatus further having two additional vibrators, one at each end of said barrel and each having a motor, an output shaft having unbalancing weights on the upper and lower ends of said shaft at a predetermined angle to each other around the axis of the shaft, a sprocket on the shafts of each of the vibrators, and chains connecting said sprockets for synchronizing the rotation of said shafts.

* * * * *